United States Patent [19]

Inaba et al.

[11] 4,041,686

[45] Aug. 16, 1977

[54] METHOD OF AND ARRANGEMENT FOR TRANSPORTING YARN PACKAGES

[75] Inventors: Mitugu Inaba, Ibaragi; Noriyuki Kouguchi, Nishinomiya; Masao Kagawa, Suita; Kozo Hosho; Yoshiaki Teraoka, both of Osaka, all of Japan

[73] Assignee: Toray Industries, Inc., Tokyo, Japan

[21] Appl. No.: 752,623

[22] Filed: Dec. 20, 1976

[51] Int. Cl.[2] ..... D01H 9/00; D01H 9/18; B65H 54/22

[52] U.S. Cl. ..... 57/34 R; 57/52; 57/156; 214/16.1 R; 214/38 R; 242/35.5 A

[58] Field of Search ..... 57/34 R, 34 HS, 52, 57/53, 54, 156, 157, 1 R; 214/16.1 R, 16.1 C, 16 R, 16 B, 16.4 R, 16.4 A, 16.4 B, 38 R, 38 A, 38 B, 38 BB, 38 D; 242/35.5 A, 79

[56] References Cited

U.S. PATENT DOCUMENTS

| | | | |
|---|---|---|---|
| 3,773,191 | 11/1973 | Ishida | 214/16.1 R |
| 3,788,054 | 1/1974 | Haussmann et al. | 57/34 R |
| 3,822,044 | 7/1974 | Riekkinen | 242/79 |
| 3,854,275 | 12/1974 | Bethea et al. | 57/34 R |
| 3,884,026 | 5/1975 | Yoshizawa et al. | 57/34 R |
| 3,895,725 | 7/1975 | Mayer | 57/53 X |
| 3,906,712 | 9/1975 | Miyazaki et al. | 57/53 |
| 3,924,762 | 12/1975 | Igel | 214/38 B |
| 3,946,547 | 3/1976 | Salmoiraghi | 57/52 |
| 3,950,928 | 4/1976 | Murakami et al. | 57/34 HS |
| 3,955,906 | 5/1976 | Murase et al. | 57/1 R X |

*Primary Examiner*—John Petrakes
*Attorney, Agent, or Firm*—J. Harold Nissen

[57] ABSTRACT

A method of transporting yarn packages is disclosed, in which yarn packages formed by a first yarn package forming machine or machines of a pre-processing process are transported to another yarn package forming machine or machines of a post-processing in a completely automated manner. The method makes it possible to readily trace the production history of each yarn package while it is processed by the yarn package forming machine of the post-processing process. An arrangement for transporting yarn packages is also disclosed in which yarn packages are transported from a first processing region to a second processing region by first and second yarn package transporting carriers via a yarn package transferring stage. In the arrangement, a mutual positional relationship between the yarn packages loaded on the first yarn package transporting carrier or carriers is unchanged from that between the yarn packages while they were being formed in the first processing region. The yarn packages loaded on the first yarn package transporting carrier or carriers are transferred to the second yarn package transporting carrier or carriers in a predetermind sequence by means of a transferring device provided in the yarn package transferring stage.

15 Claims, 12 Drawing Figures

METHOD OF AND ARRANGEMENT FOR TRANSPORTING YARN PACKAGES

FIELD OF THE INVENTION

The present invention relates to a method of and arrangement for transporting yarn packages in a filament yarn producing works. The method and arrangement are advantageously adopted for transporting undrawn synthetic yarn packages formed by, for example, a spinning machine to another yarn package forming machine, such as a drawing machine, draw-twisting machine, and draw-false-twisting machine located remotely from the spinning machine.

BACKGROUND OF THE INVENTION

In a process for producing fibers, such as a synthetic fiber, it is quite conventional to adopt a method in which a yarn package transporting car or cars are employed for transporting undrawn yarn packages formed by a spinning machine to a so-called post processing machine in a subsequent process, such as a drawing machine, a draw-twisting machine and a draw-false-twisting machine. The method is very advantageous for promoting the transporting efficiency of the yarn packages. However, there has not yet been provided any automatic yarn package transporting method with a high labor-saving efficiency, in which method a series of operations, including doffing of undrawn yarn packages from a spinning machine, transporting of the doffed undrawn yarn packages, supplying of the undrawn yarn packages to a post processing machine, and returning of an emptied transporting cars after completion of the supplying of the undrawn yarn packages to the post processing machine, are organically interconnected.

Further, in order to realize a complete automation of a yarn package transporting method for the sake of heightening the production efficiency of diverse fibers, it is indispensably required for acquiring high quality fibers that, when a faulty portion of yarn is detected during the supplying of the yarns to a post processing machine in a drawing process, draw-twisting process or draw-false-twisting process, it can not only be easily confirmed which winding spindle of which spinning machine caused the detected faulty portion of the yarn, but also, the winding spindle that produced the faulty yarn portion can be quickly repaired.

SUMMARY OF THE INVENTION

Accordingly, a principal object of the present invention is to provide a highly automated method of and arrangement for transporting yarn packages whereby the labor-saving effect in transporting the yarn packages is very large.

Another object of the present invention is to provide a method of and arrangement for transporting yarn packages whereby in a fiber production process consisting of a pre-processing process for forming undrawn yarn packages and a post-processing process, including a drawing process, a draw-twisting process or a draw-false-twisting process, the spinning machine which formed the yarn package processed by each post-processing machine is known.

A further object of the present invention is to provide a method of and arrangement for transporting yarn packages whereby commercially available yarn package forming machines are immediately employed as machines used in the pre-processing process and the post-processing process.

In accordance with one aspect of the present invention, there is provided a method of transporting yarn packages from a first processing region, in which at least a first yarn package forming machine is arranged which has a plurality of winding mechanisms, each having at least one winding spindle, into a second processing region, in which at least a second yarn package forming machine is arranged which has a plurality of winding mechanisms, the method comprising:

doffing the yarn packages from the first yarn package forming machine and loading the doffed yarn packages onto a plurality of yarn package holding pegs of a first transporting carrier conveyed to a side of said first yarn package forming machine so that the mutual positional relationship between said yarn packages on said plurality of yarn package holding pegs is unchanged from that between said yarn packages while they were being formed by said first yarn package forming machine;

conveying said first transporting carrier loaded with said doffed yarn packages to a yarn package transferring stage;

transferring, at said yarn package transferring stage, said yarn packages from said plurality of pegs of said first transporting carrier to a plurality of yarn package holding pegs of a second transporting carrier, each of said yarn packages being transferred onto a predetermined peg of said second transporting carrier;

returning, after completion of said transferring of said yarn packages, the emptied first transporting carrier to a place adjacent to said first yarn package forming machine in said first processing region, thereby permitting said first transferring carrier to again receive freshly formed yarn packages from said first yarn package forming machine;

conveying said second transporting carrier loaded with said yarn packages transferred from said first transporting carrier to a position above said second yarn package forming machine in said second processing region, thereby permitting said second transporting carrier to function as a creel car for supplying filament yarns, which are unwound from said yarn packages, to said second yarn package forming machine, and;

returning said second transporting machine toward said yarn package transferring stage after completion of said supplying of said filament yarns.

In accordance with another aspect of the present invention, there is provided an arrangement for transporting yarn packages which comprises: at least a first yarn package forming machine having a plurality of winding mechanisms, each having at least one winding spindle; at least a second yarn package forming machine having a plurality of winding mechanisms, said second yarn package forming machine being spaced apart from said first yarn package forming machine; means for doffing said yarn packages from said plurality of winding mechanisms of said first yarn package forming machine; first means for transporting said yarn packages doffed by said doffing means into a yarn package transferring stage located between said first and second yarn package forming machines, said first transporting means having means for holding said doffed yarn packages; second means for transporting said yarn packages from said yarn package transferring stage to said second yarn package forming machine when said yarn packages are transferred from said first transporting means onto said second transporting means, said second transporting means having means for holding said transferred yarn packages and being capable of functioning as creel means for supplying filament yarns to said second yarn package forming machine; first means for conveying said first transporting means from a side of said first yarn package forming machine to said yarn package transferring stage and for returning said first transporting means from said yarn package transferring stage toward said first yarn package forming machine, and; second means for conveying said second transporting means from said yarn package transferring stage to said second yarn package forming machine and for returning said second transporting means from said second yarn package forming machine toward said yarn package transferring stage.

Further objects, features and advantages of the present invention will be readily understood from the ensuing description with reference to the accompanying drawings illustrating typical embodiments of the present invention.

DESCRIPTION OF THE PREFERRED EMBODIMENTS

Figure 1:
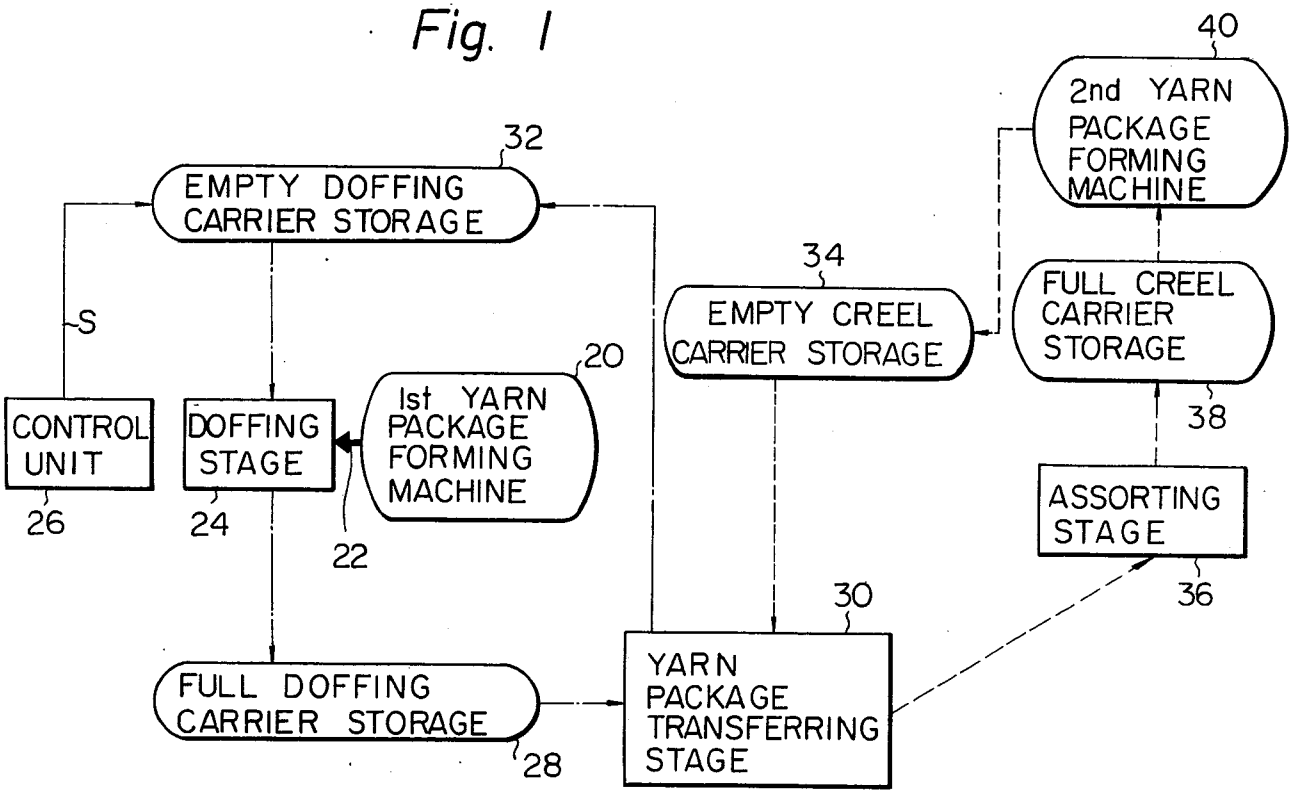
FIG. 1 is a block diagram of an arrangement for practising a yarn package transporting method according to the present invention in a yarn manufacturing factory.

Referring now to FIG. 1, which is a block diagram showing basic operations of an arrangement for practising the yarn package transporting method of the present invention in a yarn manufacturing factory, a first yarn package forming machine 20 is, for example, a spinning machine and it always produces undrawn yarn packages. Undrawn yarn package prepared in this first yarn package forming machine 20 are doffed to a doffing carrier (not shown in FIG. 1) standing by at a doffing stage 24 as indicated by a line 22. An empty doffing carrier is transported in this doffing stage 24 from an empty doffing carrier storage station 32 and is made to stand by at this doffing stage 24. Preferably, the time for delivery of the doffing carrier into the doffing stage is controlled by a start command signal S given by a control unit 26, comprising a known electronic computor device, according to a certain program stored in the control unit 26 and; the doffing carrier is delivered from the storage station 32 into the doffing stage 24 by appropriate automatic conveying means (not shown in FIG. 1). When the yarn package doffing operation is completed, the doffing carrier loaded with the yarn packages is transported to a full doffing carrier storage station 28. The loaded doffing carrier in the storage station 28 is then transported to a yarn package transferring stage 30 in which an empty creel carrier transported from an empty creel carrier storage station 34 stands by. To this transferring stage 30 loaded doffing carriers are successively transported, and yarn packages are successively transferred to creel carriers from doffing carriers in this transferring stage 30. After completion of transfer of yarn packages, empty doffing carriers are returned to the above-mentioned empty doffing carrier storage station 32 by appropriate conveying means. The creel carriers which have received the yarn packages from the doffing carriers in the transferring stage 30 are transported to an assorting stage 36 where creel carriers are assorted according to the kinds of the yarn packages. Then, each creel carrier is transported to a prescribed storage position in a full creel carrier storage station 38 and stored at this storage position. After that, the loaded creel carrier is transported to a prescribed second yarn package forming machine 40, for example, a draw-twisting machine, according to the kind of packages thereon, to supply filaments to the second yarn package forming machine 40. The empty creel carrier from which the supply of filaments has been completed is returned to the above-mentioned empty creel carrier storage station 34 by appropriate conveying means. It must be noted that only basic operations in one embodiment of the yarn package transporting arrangement are illustrated in FIG. 1 and that the particular yarn package doffing method and yarn package transporting method detailed hereinafter are carried out at the doffing stage 24 and yarn package transferring stage 30, respectively.

Figure 2:
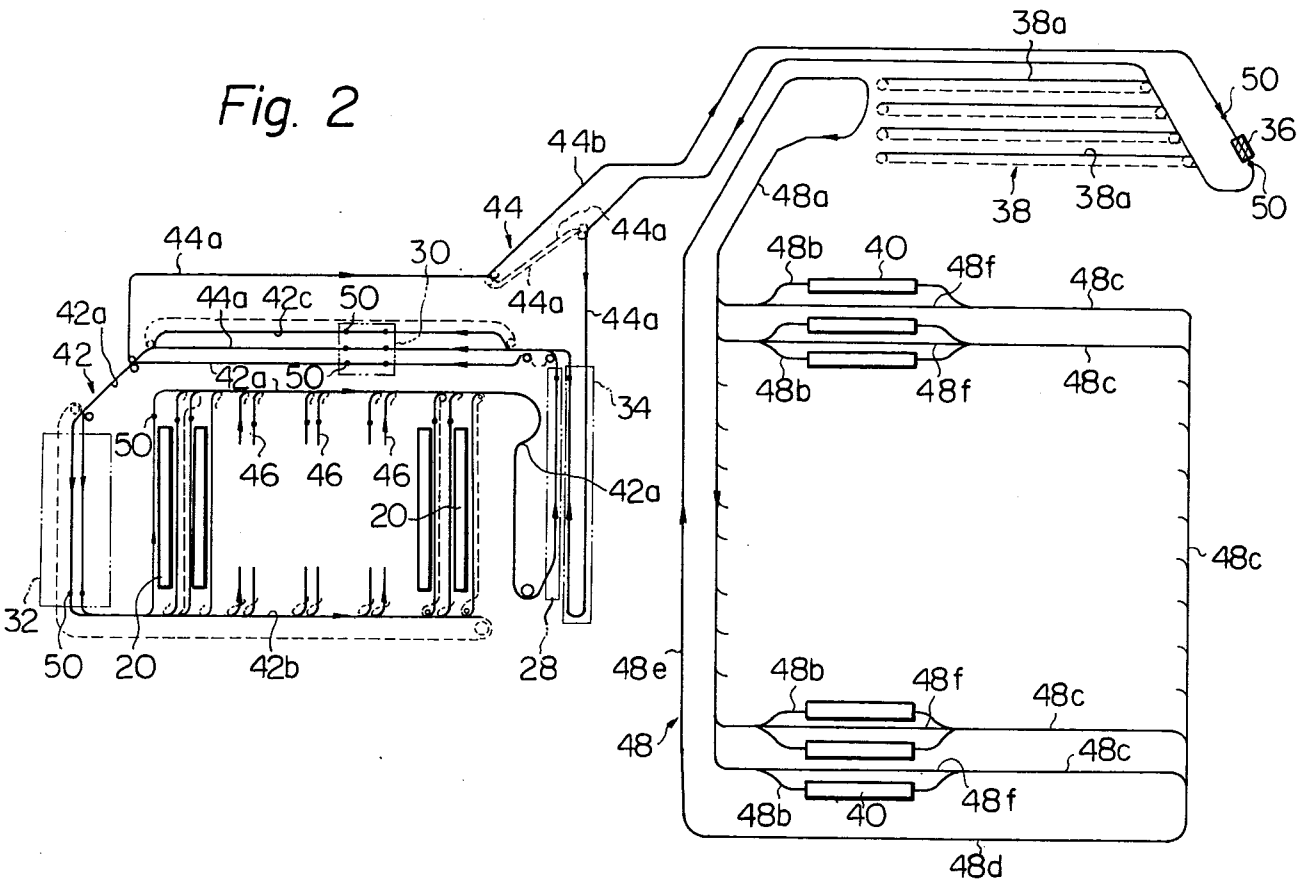
FIG. 2 is a plan view fragmentarily showing an arrangement for transporting yarn packages, according to the present invention.

FIG. 2 is a plan view showing another embodiment of the yarn package transporting arrangement according to the present invention, in which stages having the same functions as in FIG. 1 and the first and second yarn package forming machines are represented by the same reference numerals. In the transporting arrangement shown in FIG. 2, a plurality of first yarn package forming machines 20, for example, spinning machines, are arranged at appropriate intervals in one part of a yarn manufacturing factory. In the embodiment shown in FIG. 2, a yarn package transferring stage 30 and storages 28, 32 and 34 for doffing carriers and empty creel carriers are arranged around the first yarn package forming machines 20, and; an assorting stage 36 and a full creel carrier storage 38 are located in the vicinity of second yarn package forming machines. In FIG. 2 arrow lines indicate conveyance passages for transporting doffing carriers (explained in detail hereinafter with reference to FIGS. 3 to 5) and creel carriers (explained in detail hereinafter with reference to FIGS. 11 and 12). In the side portions of the first yarn package forming machines 20 and around the periphery of the region for arranging the yarn package forming machines 20, a main conveyance passage 42 and subsidiary conveyance passages 46 are laid out to convey mainly doffing carriers. A circular coveyance passage 44 is laid out to convey creel carriers and connect the yarn package transferring stage 30 with creel carrier storages 34 and 38. An entirely closed conveyance passage 48 is laid out between the full creel carrier storage 38 and the second yarn package forming machines 40 to transport loaded creel carriers to the machines 40 from the storage 38 and transport empty creel carriers to the creel carrier conveyance passage 44 from the machines 40. Further, a plurality of creel carrier conveyance passages 38*a* are laid out in the storage 38 for storing loaded creel carriers therein. In the embodiment shown in FIG. 2, each of the conveyance passages 42, 44, 46 and 38*a* comprises a plurality of endless chains driven by an electric motor (not shown). More specifically, the conveyance passage 42 includes three endless chains 42*a*, 42*b* and 42*c* and the conveyance passage 44 includes two endless chains 44*a* and 44*b*. Preferably, the conveyance passage 48 is formed as a passage for a tractor (not shown) pulling creel carriers, so that the tractor pulls out yarn package loaded creel carriers from the storage 38, transports the creel carriers through the running portions 48*a* and 48*b* of the conveyance passage 48 to the second yarn package forming machine 40 and, after separation of the creel carriers, the tractor returns to the vicinity of the storage 38 along the running portions 48*c*, 48*d* and 48*e* of the conveyance passage 48 and again pulls loaded creel carriers. A running portion 48*f* is laid out for the tractor to pull empty creel carriers which have finished supplying filaments and deliver them to the conveyance passage 44. Preferably, the conveyance passage 48, including running portions 48*a* to 48*f*, is formed as an electromagnetic guide passage and it co-operates with an excitation coil attached to the tractor to move the tractor. It is preferred that all the conveyance passages be disposed below the running floor face for the doffing carriers, creel carriers and tractors. Black points 50 shown in FIG. 2 represent stoppers for mechanically stopping doffing carriers or creel carriers according to need, which will be described hereinafter.

Figure 3:
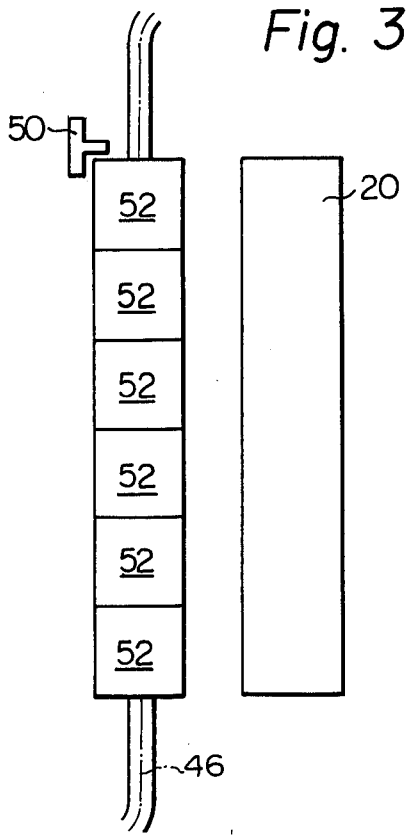
FIG. 3 is a partial and fragmentary plan view illustrating a state where a first transporting carrier is stopped so as to face a first yarn package forming machine and doffing of yarn packages is performed in the arrangement of FIG. 2.
Figure 4:
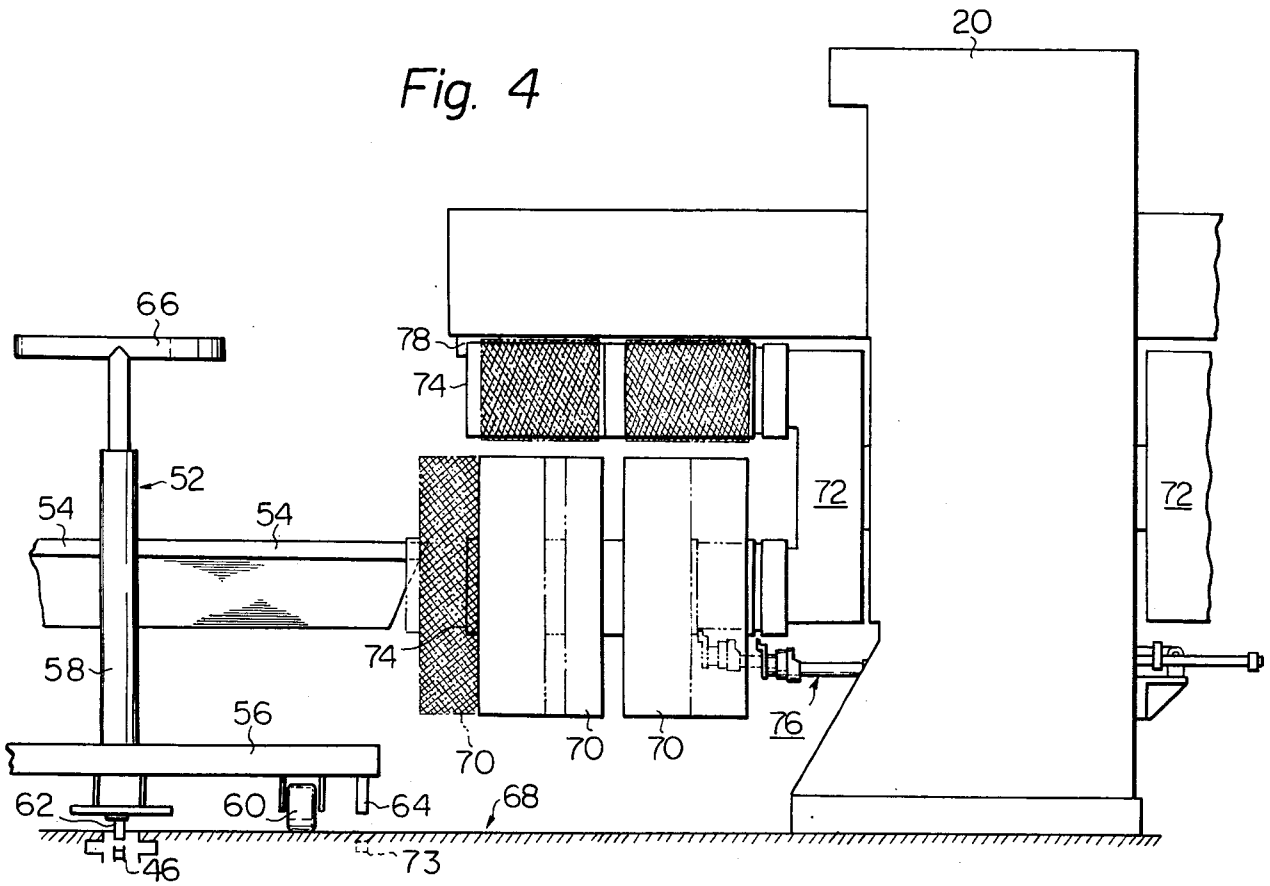
FIG. 4 is a partial and fragmentary side view illustrating a state where yarn packages are doffed from a first yarn package forming machine, and are loaded onto a first transporting carrier in the arrangement of FIG. 2.

FIGS. 3 and 4 illustrate the state where yarn packages are doffed to doffing carriers from the first yarn package forming machine 20 in the yarn package transporting arrangement shown in FIG. 2. Reference numeral 52 represents a doffing carrier. FIG. 3 illustrates an embodiment in which six doffing carriers 52 are stopped at the doffing stage 24 (see FIG. 1) on the side of the first yarn package forming machine 20. When the foremost doffing carrier 52 is stopped by a stopper 50 schematically shown in FIG. 3, these six doffing carriers 52 are stopped while keeping a certain positional relationship to the first yarn package forming machine 20. More specifically, as shown in FIG. 4, at the doffing stage 24 (see FIG. 1) the doffing carriers are stopped so that a plurality of pegs 54 of each doffing carrier 52 confront linearly the winding spindles 74 of each winding mechanism 72 mounted on the first yarn package forming machine 20. Accordingly, completed yarn packages 70 are pushed out by known doffing devices 76 mounted on the machine 20 and doffed to pegs 54 of the doffing carrier 52 from the winding spindles 74. The first yarn package forming machine 20 shown in FIG. 4 has a rotary winding mechanism and, when a yarn package 70 is doffed by the lower winding spindle 74, winding of new filaments has already started on the upper winding spindle 74. Reference numeral 78 represents a known driving drum. In FIG. 4, it is shown that a pair of completed yarn packages 70 are doffed at one time from each winding spindle 74. Accordingly, when a commercially available rotary spin-winding machine having laterally arranged 36 sets of winding mechanisms 72 on one side face is used as the first yarn package forming machine 20, 36 pairs (42) of completed packages 70 can be doffed at one time to six doffing carriers 52, since a pair of completed yarn packages 70 are doffed from each of the 36 winding mechanisms of the spin-winding machine. In this case, six pegs 54 are mounted on to receive 6 pairs (12) of completed packages 70. Six pegs 54 of each doffing carrier 52 are disposed so that they confront linearly the lower winding spindles 74 in the corresponding winding mechanism 72. Of course, there may be adopted an arrangement in which 36 pairs (72) of completed packages 70 are doffed by four doffing carriers 52, each having nine pegs 54. Further, the number of sets of completed yarn packages to be doffed is not limited to 36 but it is possible to adopt an arrangement in which a greater number of sets of completed yarn packages 70 are doffed to a plurality of doffing carriers. It must be noted that the positional relationship between every two adjacent yarn packages is not changed whether completed packages are attached to winding spindles 74 of the machine 20 or they are in the state where they are doffed to the doffing carrier 52. In FIGS. 3 and 4, it is illustrated that completed yarn packages 70 are received from the first yarn package forming machine 20 by the doffing carrier 52 on the left side of the machine 20, but on both the left and right sides of a supporting frame 58, pegs 54 are disposed as shown in FIG. 4 so that completed yarn packages 70 can be received also on the right side of the machine 20. A pin 62 to be engaged with a conveying chain 46 at the conveyance step is formed on the lower face of a base plate 56 and, also, running wheels 60 and a permanent magnet 64 are attached to the lower face of the base plate 56. If the permanent magnet 64 is thus mounted on the doffing carrier 52, it is possible to stop the doffing carrier 52 precisely at a prescribed position in, for example, the doffing stage 24 (see FIG. 1). More specifically, if a known reed switch 73 is buried in the interior of the floor 68 of the doffing stage 24 at a prescribed position, when the permanent magnet 64 of, for example, the foremost doffing carrier 52 passes above the reed switch 73, a switch contact of the reed switch 73 is closed and an electric signal is emitted to actuate the stopper 50 (see FIG. 3) via an appropriate actuator, such as a cylinder, and mechanically stop the foremost doffing carrier 52. At this point, subsequent doffing carriers 52 are automatically stopped. The stopper 50 may be released from actuation, for example, by emitting an electric signal to the stopper 50 from the machine 20 on completion of the doffing operation. All the stoppers 50 shown in FIG. 2 are actuated in the same manner as described above. Needless to say, instead of the above-mentioned arrangement using the magnet 64 and reed switch 73, there may be adopted an arrangement in which a projection capable of operating as a mechanical actuator is formed on the doffing carrier 52 so that a known limit switch mounted on the top face of the floor 68 is actuated on contact with this projection.

Figure 5:
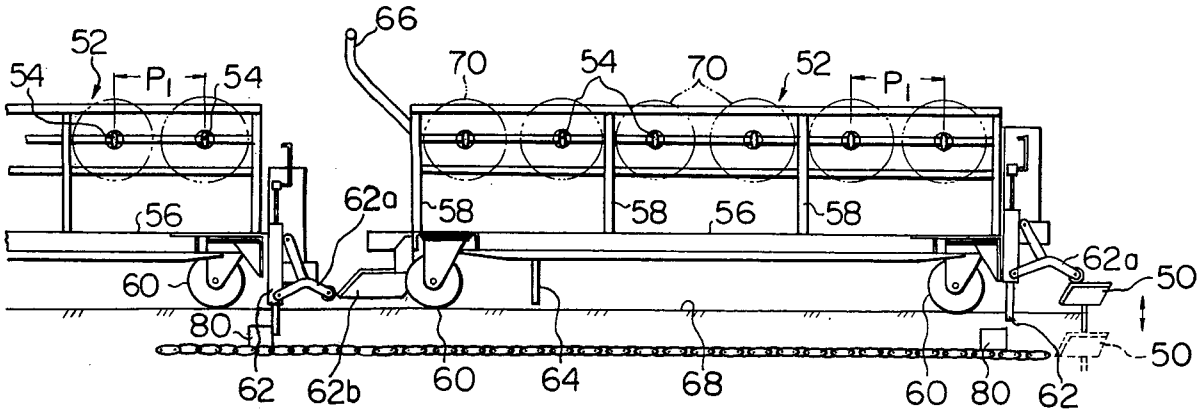
FIG. 5 is a side view showing first yarn package transporting carriers functioning as doffing carriers.

FIG. 5 is a side view showing doffing carriers 52. Each doffing carrier 52 has six pegs 54 on one side. As will readily be understood from the foregoing illustration, these pegs are arranged so that the distance P, between every adjacent peg 54 corresponds to the distance between every adjacent winding spindle 74 on the first yarn package forming machine 20 (see FIG. 4). Reference numeral 66 represents a handle disposed at the rear end of the doffing carrier 52 so that the carrier 52 can be moved manually. The pin 62 to be engaged with the endless chain of the conveyance passage is mounted on the front end portion of each doffing carrier 52 and this pin 62 is released from engagement with the endless chain when a roller arm **62*a* falls in contact with a bracket 62*b* of a preceding carrier 52 or the stopper 50 and the pin is pulled upwardly. In FIG. 5, the roller arm 62*a* of the right doffing carrier 52 contacts the stopper 50 and the right doffing carrier 52 is stopped. However, the left doffing carrier 52 is in a state where the roller arm 62*a* of the left doffing carrier 52 will contact with the bracket 62*b* of the right doffing carrier 52 soon, so that the left doffing carrier 52 is also stopped on the rear side of the right doffing carrier 52. When the pin 62 is brought down below the surface of the floor 68, it is engaged with a block 80 attached to the endless chain and the doffing carrier 52 is conveyed with the movement of the endless chain. Every two adjacent doffing carriers 52** may be connected to each other by appropriate connecting means.

Figure 6:
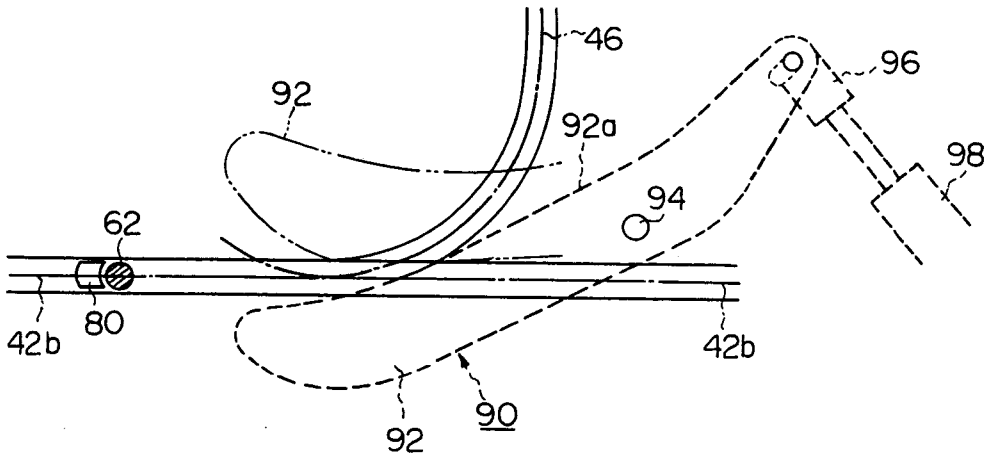
FIG. 6 is a plan view showing an example of a changing-over device of conveying passageways for conveying yarn package transporting carriers, which is provided in the arrangement of FIG. 2.

FIG. 6 is a plan view showing an example of a change-over device for changing over conveyance of the doffing carrier 52 by one endless chain to conveyance by another endless chain in the conveyance passage system shown in FIG. 2, especially the guiding of the doffing carrier 52 from the endless chain **42*b* to the endless chain 46 in FIG. 2. The change-over device 90 comprises a paddle 92, a pivot shaft 94, a connecting rod 96 and a cylinder device 98. Each of these elements are disposed below the surface of the floor on which the doffing carrier 52 runs, and the paddle 92 is a plate member mounted turnably around the pivot shaft 94. The cylinder device 98 turns the paddle 92 through the connecting rod 96. The plate-like paddle 92 is disposed just below the surface of the floor, and when the paddle 92 is turned to a position indicated by a two dot dash line in FIG. 6, by contact of the pin 62 of the doffing carrier with one side 92*a* of the plate-like paddle 92, the doffing carrier 52 is shifted from the running passage of the endless chain 42*b* to the running passage of the endless chain 46. At this point, the block 80 of the endless chain 42*b* runs through a point much lower than the position of the plate-like paddle 92 so that it is prevented from collision with the plate-like paddle 92. When the plate-like paddle 92 is turned to the position indicated by a dashed line shown in FIG. 6, change-over of the conveyance passage of the doffing carrier is not performed and the doffing carrier 52 passes through the change-over point while being conveyed by the endless chain 42*b*. The turning operation of the paddle 92 is performed by controlling the operation of the cylinder device 98 in response to an appropriate signal indicating whether or not change-over of the conveyance passage of the doffing carrier is necessary. This control signal may be generated from the control unit 26 shown in FIG. 1 or by utilizing a combination of the permanent magnet 64 (see FIG. 4) mounted on the doffing carrier 52 and the reed switch 73 buried in the interior of the floor. In the conveyance passage system shown in FIG. 2, all the points where two endless chains come close to each other are provided with change-over devices 90 shown in FIG. 6 or simple fixed guides so that doffing carriers 52** or creel carriers are conveyed smoothly along a prescribed conveyance passage.

Figure 7:
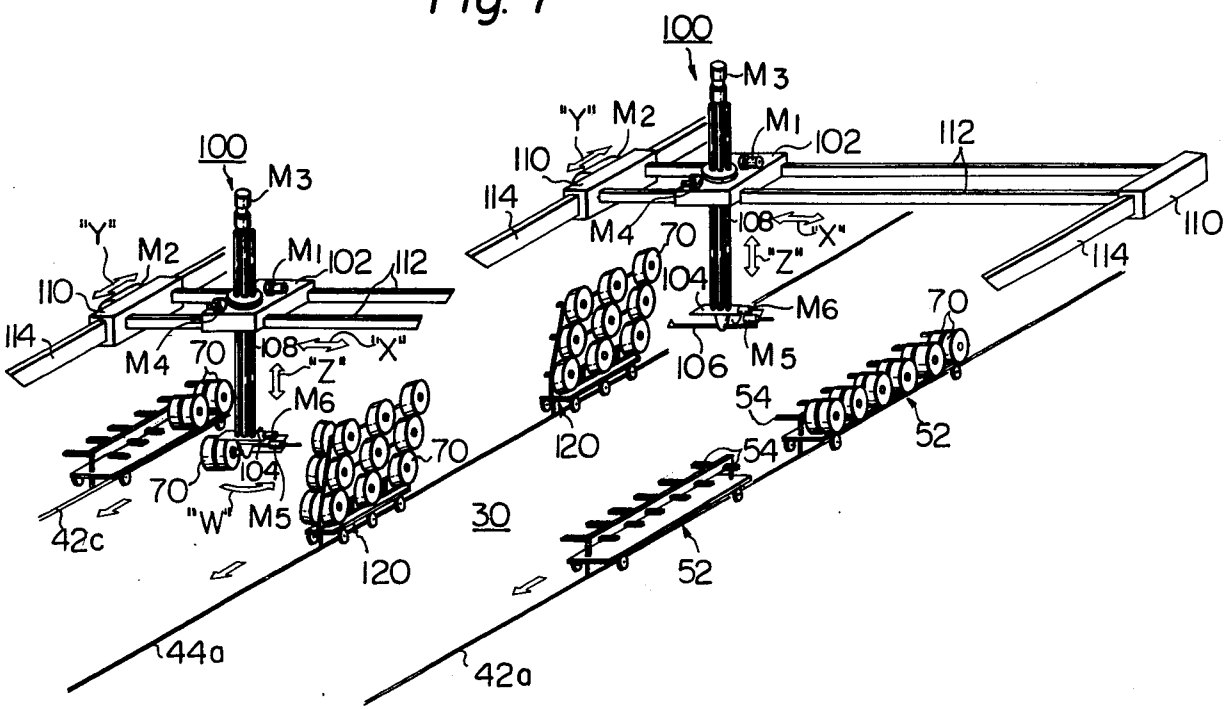
FIG. 7 is a perspective view illustrating transferring devices provided in a yarn package transferring stage and first and second yarn package transporting carriers conveyed into the yarn package transferring stage.

FIG. 7 illustrates a yarn package transfer device 100 mounted in the transferring stage 30 of the yarn package transportation arrangement shown in FIG. 2. In an embodment shown in FIG. 7, two yarn transfer devices 100 are disposed one behind the other along the conveyance passages **42*a* and 42*c* of the doffing carrier 52 and the conveyance passage 44*a* for the creel carrier 120. The two transfer devices 100 have the same structure. Therefore, only the structure of the rear transfer device 100** will now be described in detail.

The transfer device 100 comprises a mount 102, a transfer head 104, a yarn package carrying arm 106, a longitudinal column 108, two lateral beams 112 and a pair of slider boxes 110. Both the mount 102 and head 104 are driven by a motor M1 so that they can slide in the direction of an arrow X along the lateral beams 112. The slider boxes 110 are driven by a motor M2 so that they can slide along a fixed rail 114 in the direction of an arrow Y. Needless to say, when a pair of slider boxes 110 slide in the direction Y, the lateral beams 112 attached to the slider boxes 110 and the mount 102 mounted on the lateral beams 112 are also moved in the direction Y. Therefore, the transfer head 104 attached to the mount 102 through the longitudinal column 108 is moved in the direction Y. A motor M3 attached to the top of the longitudinal column 108 is disposed to drive the longitudinal column 108 and transfer head 104 in the direction of an arrow Z with respect to the mount 102. A motor M4 attached to the mount 102 is disposed to drive the column 108 and turn the head 104 around the axis of the column 108. A motor M6 is mounted on the head 104 to incline the arm 106 and another motor M5 is mounted on the head 104 to advance and retreat the arm 106 in the axial direction thereof, whereby the arm 106 of the transfer device 100 is allowed to perform a very complicated operation. Namely, when the doffing carrier 52 loaded with yarn packages 70 and the empty creel carrier 120 are stopped with the transfer head 104 being intervened therebetween, the yarn package carrying arm 106 of the transfer head 104 is actuated to transfer efficiently the yarn packages 70 from the doffing carrier 52 to the creel carrier 120. FIG. 7 illustrates the state in which the front transfer device 100 transfers the yarn packages 70 to the creel carrier 120 from the doffing carrier 52 transported to the transferring stage 30 through the conveyance passage **42*c* and stopped in the transferring stage 30, and; the state in which the rear transfer device 100 transfers the yarn packages 70 to the creel carrier 120 from the doffing carrier 52 transported to the transferring stage 30 through the conveyance passage 42*a* and stopped in the transferring stage 30. As pointed out hereinbefore, after transfer of the yarn packages 70 the empty doffing carrier 52 is then transported through the conveyance passage 42*a* or 42*c* from the transferring stage 30 to the storage station 32 (see FIG. 2) for empty doffing carriers 52**.

Figure 8:
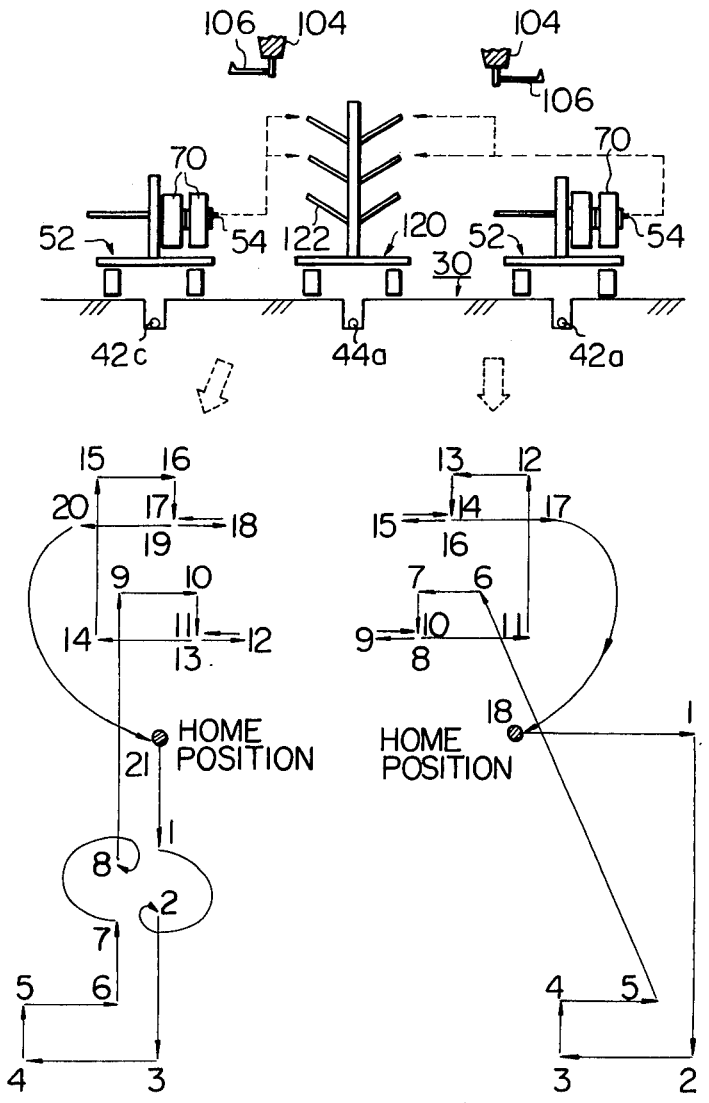
FIG. 8 is a diagram illustrating the transferring operation performed in the yarn package transferring stage.

FIG. 8 is a diagram illustrating the sequence of operations performed by the yarn package carrying arm 106 of the transfer device 100 when yarn packages are transferred from the doffing carrier 52 to the creel carrier 120. In FIG. 8, the left arm 106 corresponds to the arm 106 of the front transfer device 100 shown in FIG. 7 and the right arm 106 corresponds to the arm 106 of the rear transfer device 100 in FIG. 7. Just before transfer of a pair of yarn packages 70 from the doffing carrier 52 to the creel carrier 120, the left arm 106 in FIG. 8 is located at a home position facing yarn package carrying pegs 122 of the creel carrier 120. When the transfer operation starts, the head 107 is brought down to position 1 by the driving force of the motor M3 shown in FIG. 7 and then turned by the driving force of the motor M4 shown in FIG. 7 to direct the arm 106 to the doffing carrier 52 as shown in FIG. 8. Then, the head 107 is brought down to position 3 by the driving force of the motor M3, and at this point, the arm 106 is located slightly above the central portion of the yarn package 70 on the doffing carrier 52. Then, by the driving force of the motor M1 shown in FIG. 7, the arm 106 is inserted into the winding bobbin in the yarn package 70 and is moved to position 4. Then, by the driving force of the motor M3 the arm 106 is shifted from position 4 to position 5 and the yarn package 70 is held by the arm 106. Then, the arm 106 is moved to position 6 by the driving force of the motor M1, and at this point, the yarn package separates from the peg 54 of the doffing carrier 52 and is completely held on the arm 106 of the transfer device 100. Then, by the driving forces of the motors M3, M4 and M1, the head 104 and arm 106 are shifted to position 10 from position 6 and at this point, there is attained a state where the yarn package 70 can be transferred from the arm 106 to one peg 122 of the creel carrier 120. Accordingly, when the head 104 and arm 106 are brought down from position 10 to position 11, one yarn package 70 on the arm 106 is engaged with the top end of the peg 122 of the creel carrier 120 through the winding bobbin of the yarn package 70. In this state, the arm 106 is inclined in compliance with inclination of the peg 122 of the creel carrier 120 by the motor M6 of the head 104, and when the arm 106 is projected toward the creel carrier 120, the yarn package 70 engaged with the top end of the peg 122 is pushed toward the peg 122 of the creel carrier 120. The pushed position is indicated by reference numeral 12. Then, the arm 106 is returned to position 13 by the motor M5 and is made horizontal by the motor M6, and one yarn package 70 is transferred to the creel carrier 120. Then, the arm 106 is moved to position 14 by the driving force of the motor M1. At this point, one remaining yarn package 70 is still held on the arm 106. While the arm 106 is shifted from position 14 to position 19 by the driving forces of the motors M3, M1, M5 and M6, the yarn package 70 is transferred to another peg 122 of the creel carrier 120. No yarn package 70 is held on the arm 106 which arrives at position 19. Then, the arm 106 is returned to home position 21 while it is driven together with the motors M1 and M3 by the motor M2 shown in FIG. 7. It should be understood that this home position 21 is changed from the original home position and is arranged so that the transferring of another pair of yarn packages 70 held on the peg 54 of the doffing carrier 52 is permitted. In the foregoing manner, all of the yarn packages 70 on the doffing carrier 52 are subsequently transferred to prescribed pegs 122 on the creel carrier 120, according to a prescribed order, by the transfer device 100. The arm 106 of the right head 104 shown in FIG. 8 performs transfer of the yarn package 70 from the doffing carrier 52 to the creel carrier 120 by only three operations in directions X, Y and Z by the driving forces of the motors M1, M2 and M3, and the turning operation by the motor M4 is not required for transfer of the yarn package 70. Of course, the arm 106 receives the driving forces of the motors M5 and M6 in FIG. 7 for pushing the yarn package 70 completely on the peg 122 of the creel carrier 120.

Figure 9:
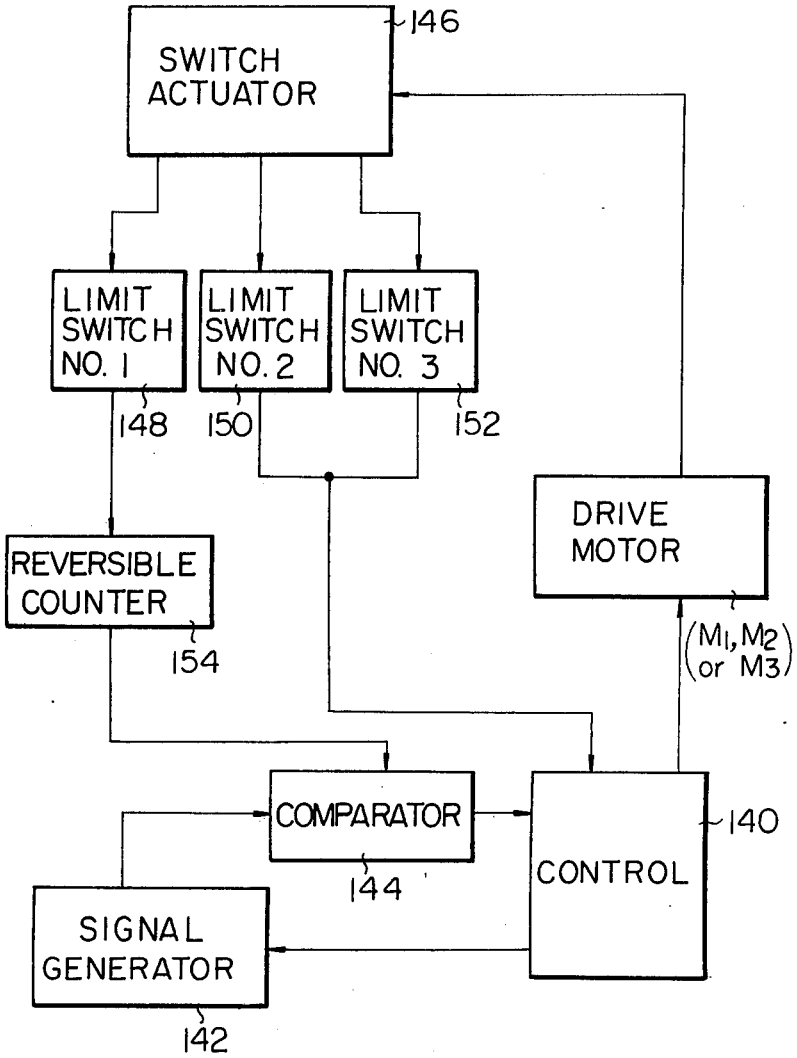
FIG. 9 is a block diagram illustrating a controlling method of the operation of the yarn package transferring device.

FIG. 9 is a block diagram of a control system for controlling the driving motors M1, M2 and M3 for operating the head 104 and arm 106 of the transfer device 100 shown in FIG. 7 in the three directions X, Y and Z. This control system shown in the block diagram of FIG. 9 will now be described by reference to the motor M1 for driving the head 104 and arm 106 in the direction X, which is shown in FIG. 7. A switch actuator 146 is attached to the mount 102 shown in FIG. 7, and this actuator 146 may be, for example, a mechanical projection fixed to the side of the mount 102. A plurality of limit switches 148, 150 and 152 are appropriately attached to the lateral beam 112 shown in FIG. 7. The limit switch 148 is used for emitting count signals, and the limit switches 150 and 152 are used for emitting decelerating signals and brake signals for the motor M1. A reversible counter 154 is disposed to receive and count the count signals from the limit switch 148. Reference numeral 140 represents a control unit (not shown in FIG. 7) attached to an appropriate position of the transfer device 100, and a signal generator 142 and a comparator 144 are built in this control unit 140. The control unit 140 applies numerical instructions indicating the prescribed stop position of the mount 102 in the direction X to the signal generator 142 according to the prescribed stored program. The signal generator 142 generates numerical signals corresponding to said numerical instructions and puts them in the comparator 144. The count number is added to the reversible counter 154 every time the switch actuator 146 of the mount 102 actuates the limit switch 148 and, simultaneously, a signal is applied to the comparator 144 at every count. When the numerical signal in the comparator 144 is in agreement with the count number of the reversible counter 154, the control unit 140 is ready for control of the driving motor M1. More specifically, after receipt of the agreement signal from the comparator 144, the limit switch 150 is actuated by the actuator 146 and, at this point, the control unit 140 receives the signal from the limit switch 150 and sends a decelerating signal to the motor M1 to decelerate the rotation of the motor M1. When the limit switch 152 is then actuated by the actuator 146, the control unit 140 receives the signal from the limit switch 152 and sends a brake signal to the motor M1 to stop the motor M1 immediately. Since the motor M1 receives decelerating instructions from the control unit 140 prior to receipt of brake instructions, it can be immediately stopped on receipt of the brake signal.

In connection with the motor M2 for the operation in the direction Y in FIG. 7, an actuator 146 is attached to a slider box 140, and a plurality of limit switches 148, 150 and 152 are attached to the fixed rail 114. By this arrangement, the motor M2 is controlled in the same manner as the drive motor M1 for the operation in the direction X is controlled. In connection with the motor M3 for the operation in the direction Z in FIG. 7, an actuator 146 is attached to a column 108 which is a movable member and limit switches 148, 150 and 152 are attached to the mount 102, whereby the motor M3 is controlled in the same manner as described above with respect to the motor M1.

As will readily be understood from the foregoing illustration, in the transferring stage 30 of the yarn package transporting arrangement of the present invention, yarn packages are transferred from doffing carriers 52 to creel carriers 120 according to a prescribed sequence. Therefore, even after completion of the transfer operation, it is possible to know by which winding spindles 74 of the first yarn package forming machine 20 (see FIGS. 2 to 4) respective yarn packages on the creel carrier 120 have been formed. Moreover, if the transfer device 100 illustrated above is used, transfer of yarn packages 70 is performed in succession in accordance with a minimum distance movement of the head 104 of the transfer device 100 and, therefore, a great number of yarn packages can be transferred at high speed and with high efficiency.

Figure 10:
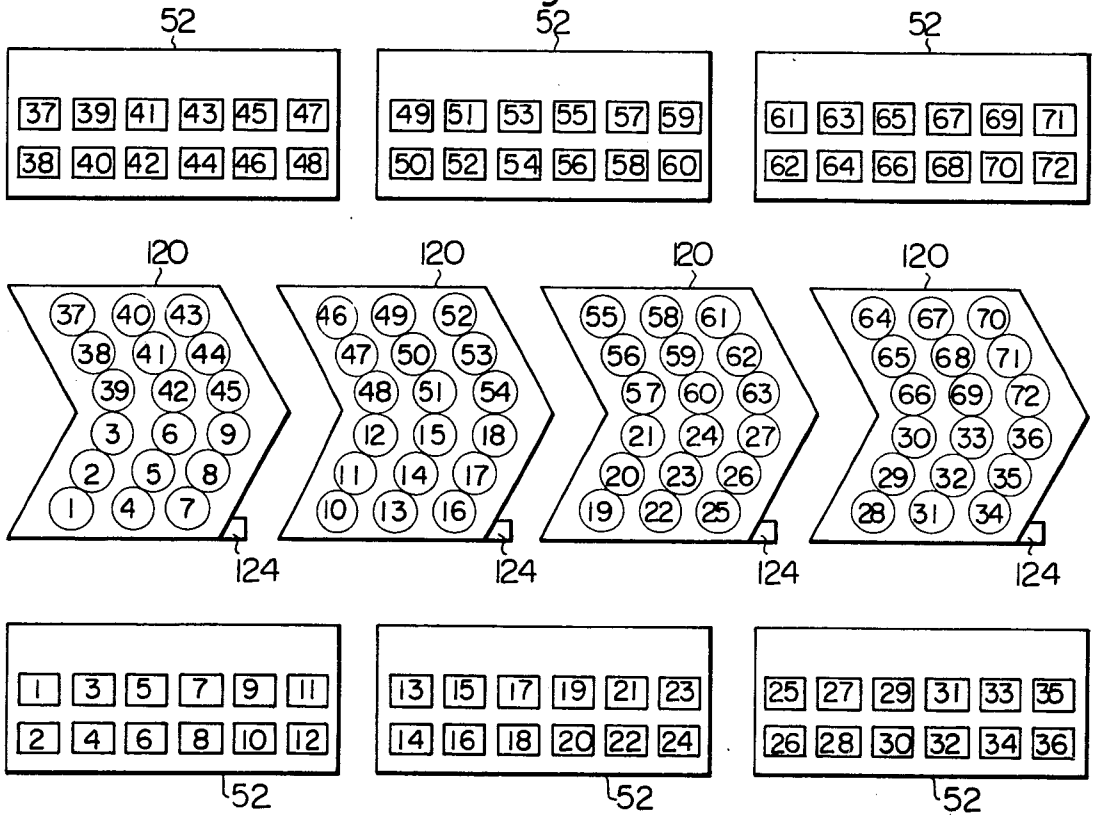
FIG. 10 is an explanatory view for illustrating the positional relationship of the yarn packages transferred from first yarn package transporting carriers to second yarn package transporting carriers.

FIG. 10 illustrates the positional relationship between yarn packages on doffing carriers 52 and yarn packages on creel carriers 120 which is established when yarn packages 70 are transferred from the doffing carriers 52 to the creel carriers 120. As in the embodiment illustrated in FIG. 3, in an embodiment shown in FIG. 10, 36 pairs (72) of yarn packages 70 doffed to six doffing carriers 52 are transferred to four creel carriers 120 (18 packages are transferred to each creel carrier 120). When six doffing carriers 52 are transported from the first yarn package forming machine 20 to the transferring stage 30 in the transporting arrangement shown in FIG. 2, three former carriers are delivered from the machine 20 into the transferring stage 30 through the conveyance passage 42*a* and the remaining three carriers are introduced into the conveyance passage 42*c* just before the transferring stage 30, so that three carriers are stopped on each of the left and right sides of four empty creel carriers 120 arranged in series. Then, yarn packages 70 on the doffing carriers 52 are subsequently transferred onto eighteen yarn package pegs 122 (see FIG. 8) formed on both the side faces of each creel carrier 120 by the above-mentioned transfer device 100. Since the transfer device 100 performs the transfer operation in the prescribed sequence, as pointed out hereinbefore, a certain positional relationship as shown in FIG. 10 is established between 72 yarn packages 70 doffed on six doffing carriers 52 and yarn packages transferred and held on the creel carriers 120. Accordingly, for example, yarn packages formed on a first winding spindle 74 of the first yarn package forming machine 20 (see FIGS. 2 to 4) are always doffed to positions 1 and 2 of the doffing carrier 52 and transferred to positions 1 and 2 of the foremost creel carrier 120 in the transferring stage 30. When the transfer operation is completed, the machine number of the yarn package forming machine 20 which has formed the yarn packages 70 transferred onto the four creel carriers 120 is appropriately recorded on each of the four creel carriers 120, and the creel carriers 120 are then transported to the second yarn package forming machine 40. Accordingly, when filaments are supplied to the second yarn package forming machine 40 from the creel carriers 120, from the machine number of the first yarn package forming machine 20 recorded on the creel carriers and the above-mentioned prescribed positional relationship among the transferred yarn packages, the winding spindles 74 (see FIG. 4) of the first yarn package forming machine 20 which have prepared the respective filaments can easily and simply be identified. Recording of the machine number of the yarn package forming machine 20 on creel carriers 120 can be performed, for example, by positioning suitable recording means 124, e.g., recording paper, on each creel carrier 120 and having an operator write the machine number of the recording paper 124 just before the loaded creel carrier 120 separates from the transferring stage 30.

Figure 11:
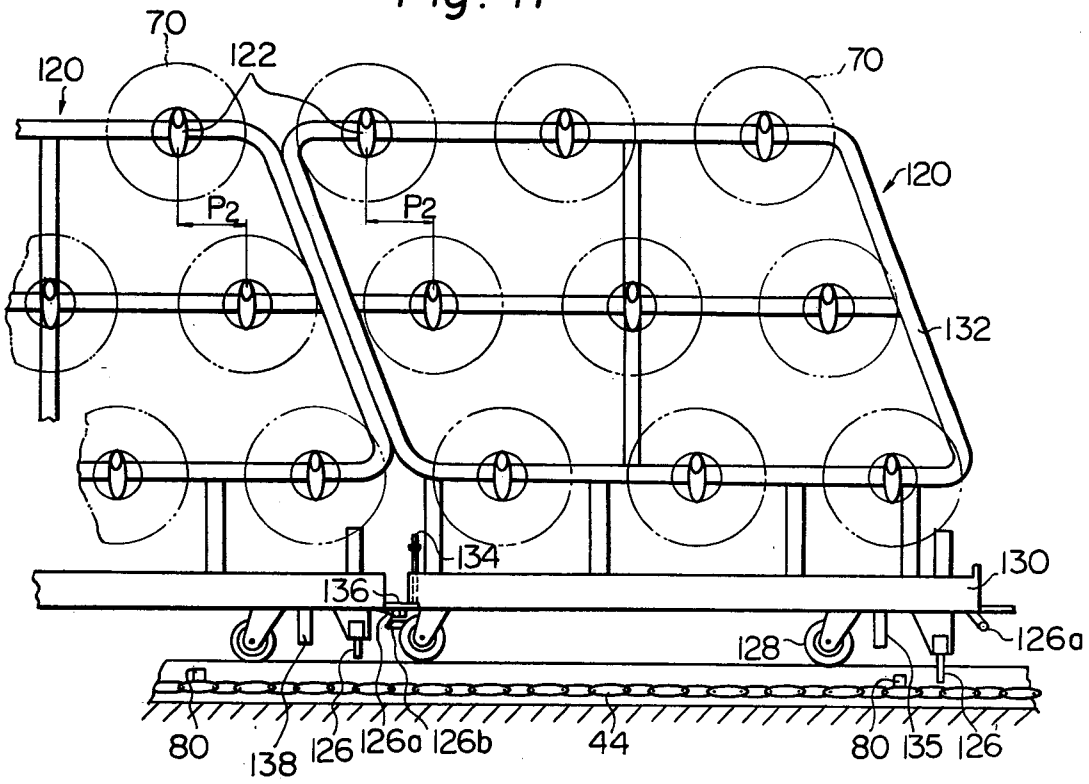
FIG. 11 is a side view illustrating second yarn package transporting carriers functioning as creel cars.

FIG. 11 is a diagram illustrating the side of the creel carrier 120. The creel carrier 120 has nine pegs 122 on each of its left and right side faces, so that it can carry 18 yarn packages 70. Accordingly, one creel carrier 120 is capable of supplying filaments to 18 winding spindles of the second yarn package forming machine 40 (see FIG. 2). The structure of the creel carrier 120 will now be described.

Referring to FIG. 11, a frame 132 is firmly attached to a base plate 130, and 18 pegs 122 are mounted on both the left and right sides of the frame 132. It is preferred that the distance $P_2$ between every adjacent peg be in agreement with the distance between every two adjacent winding spindles in the second yarn package forming machine 40. By this arrangement, supply of filaments to the second yarn package forming machine 40 can be remarkably facilitated. Wheels 128 are attached to the lower face of the base plate 130, and pins 126 having the same structure as that of the pins 62 (see FIG. 5) in the doffing carrier 52 are disposed so that they can be engaged with blocks 80 attached to the endless chain of the conveyance passage 44. Each pin 126 is arranged so that when a roller arm 126*a* falls in contact with a stopper 50 (see FIG. 2) appropriately disposed on the conveyance passage 44, the pin 126 is pushed upwardly and is released from the engagement with the endless chain to stop the creel carrier 120. A bracket 126*b* is attached to the rear end of the creel carrier 120 so that when the roller arm 126*a* of the following creel carrier 120 rides over this bracket 126*b,* the following creel carrier 120 is also stopped. Reference numerals 134 and 136 represent connecting members for connecting two adjacent creel carriers 120. Namely, when creel carriers 120 are transported from the storage 38 to the prescribed second yarn package forming machine 40 by being pulled by the tractor (not shown), creel carriers 120 are connected to each other by these connecting members 134 and 136. When the creel carriers 120 are conveyed through the conveyance passage 44, however, they are transported separately through the above-mentioned pins 126 of the respective creel carriers 120 which are engaged with the endless chain of the conveyance passage 44. Reference numeral 138 represents a permanent magnet which generates a signal for actuating the stopper 50 cooperatively with a reed switch (not shown) positioned below the surface of the running floor, as in the case of the permanent magnet 64 (see FIGS. 4 and 5) mounted on the doffing carrier 52. When this permanent magnet is mounted turnably on the base plate 130, if the creel carrier 120 is pulled by the tractor, the magnet 138 is not used and, therefore, the magnet 138 may be turned down onto the base plate 130. Further, when a plurality of creel carriers 120 are transported in a group through the conveyance passage 44, it is possible to adopt an arrangement in which only the permanent magnet of the foremost creel carrier 120 cooperates with the reed switch to actuate the stopper 50. More specifically, when the foremost creel carrier 120 is stopped, the roller arm 126*a* of the following creel carrier 120 rides over the bracket 126*b* of the stopped foremost creel carrier 120 and the pin 126 of the following creel carrier 120 is pulled upwardly. As a result, the following creel carrier 120 is also stopped.

Figure 12:
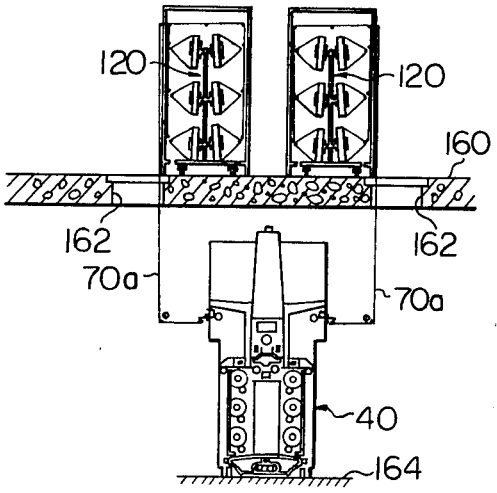
FIG. 12 is a partial cross-sectional view illustrating a state where yarns are supplied from creel cars to a second yarn package forming machine.

FIG. 12 is a sectional view illustrating the state where filaments 70*a* are supplied to the second yarn package forming machine 40. In FIG. 12, creel carriers 120 are delivered onto a second floor 160 formed above the second yarn package forming machine 40 which is disposed on a first floor 164, and filaments 70*a* are supplied to the machine 40 through yarn supply holes 162 formed in the second floor 160. It should be understood that on the first floor 164, a plurality of second yarn package forming machines are usually disposed as shown in FIG. 2. In addition, preferably, each second yarn package forming machine 40 has winding spindles (not shown in FIG. 12), the number of which is the same as or an integral times of the number of yarn packages 70 formed by and doffed at one time from each first yarn package forming machine 20 (FIG. 4). This is because, if such relationship between the number of winding spindles of the second yarn package forming machine and the number of yarn packages 70 formed by the first yarn package forming machine is established, one second yarn package forming machine 40 can process, at one time, the yarn packages formed by one or more first yarn package forming machine 20. For example, if the second yarn package forming machine 40 has a 144 winding spindles, each second yarn package forming machine 40 will be able to process the yarn packages formed by two first yarn package forming machines 20 shown in FIG. 4 at one time, since as described hereinbefore, 72 completed yarn packages 70 are doffed from each first yarn package forming machine 20 shown in FIG. 4. Thus, it should be appreciated that if the above-mentioned relationship is established, the operational efficiency of the highly automated method of and arrangement for transporting yarn packages, according to the present invention, will be very enhanced. Also, if the above-mentioned relationship is established, it is possible to establish an unchanging correspondence between the winding spindles 74 (see FIG. 4) of the first yarn package forming machines 20 and the winding spindles of the second yarn package forming machines 40. In the embodiment shown in FIG. 12, a commercially available draw-false twisting machine is used as the second yarn package forming machine 40.

The yarn package transporting method and arrangement according to the present invention have been illustrated by reference to typical embodiments thereof. As will be apparent to those skilled in the art, various changes and modifications can be made to these embodiments within the scope of the technical concept of the present invention.

What is claimed is:

1. A method of transporting yarn packages from a first processing region in which there is arranged at least a first yarn package forming machine having a plurality of winding mechanisms, each having at least one winding spindle, into a second processing region in which there is arranged at least a second yarn package forming machine having a plurality of winding mechanisms, comprising:

doffing said yarn packages from said first yarn package forming machine and loading the doffed yarn packages onto a plurality of yarn package holding pegs of a first transporting carrier conveyed to a side of said first yarn package forming machine so that the mutual positional relationship between said yarn packages on said plurality of yarn package holding pegs is unchanged from that between said yarn packages while they were being formed by said first yarn package forming machine;

conveying said first transporting carrier loaded with said doffed yarn packages to a yarn package transferring stage;

transferring, at said yarn package transferring stage, said yarn packages from said plurality of pegs of said first transporting carrier to a plurality of yarn package holding pegs of a second transporting carrier, each of said yarn packages being transferred onto a predetermined peg of said second transporting carrier;

returning, after completion of said transferring of said yarn packages, the emptied first transporting carrier to a place adjacent to said first yarn package forming machine in said first processing region, thereby permitting said first transferring carrier to again receive freshly formed yarn packages from said first yarn package forming machine;

conveying said second transporting carrier loaded with said yarn packages transferred from said first transporting carrier to a position above said second yarn package forming machine in said second processing region, thereby permitting said second transporting carrier to function as a creel car for supplying filament yarns, which are unwound from said yarn packages, to said second yarn package forming machine, and;

returning said second transporting machine toward said yarn package transferring stage after completion of said supplying of said filament yarns.

2. The method according to claim 1, in which said first transporting carrier mounts thereon said plurality of yarn package holding pegs arranged so as to be spaced apart from one another at a pitch identical with a pitch at which said winding spindles of said plurality of winding mechanisms of said first yarn package forming machines are arranged, said method further comprising the step of stopping said first transferring carrier so that said pegs of said first transporting carrier are in alignment with said winding spindles of said first yarn package forming machine, when said first transporting carrier is conveyed to the side of said first yarn package forming machine.

3. The method according to claim 1, wherein said first transporting carrier is conveyed along a predetermined closed conveying passageway extending past said side of said first yarn package forming machine and through said yarn package transferring stage, and; wherein said second transporting carrier is conveyed along a first closed conveying passageway extending through said yarn package transferring stage and a predetermined position in said second processing region, and along a second closed conveying passageway extending through said predetermined position and the position above said second yarn package forming machine.

4. The method according to claim 3, wherein when a plurality of first yarn package forming machines is arranged in said first processing region so as to form at least two different kinds of yarn packages out of filament yarns, and when said at least two different kinds of yarn packages are transported to said second processing region in which a plurality of second yarn package forming machines is arranged, said at least two different kinds of yarn packages are assorted into respective kinds at said predetermined position in said second processing region so that each kind of yarn packages is transported to positions above predetermined second yarn package forming machines.

5. An arrangement for transporting yarn packages comprising:

at least a first yarn package forming machine having a plurality of winding mechanisms, each having at least one winding spindle;

at least a second yarn package forming machine having a plurality of winding mechanisms, said second yarn package forming machine being spaced apart from said first yarn package forming machine;

means for doffing said yarn packages from said plurality of winding mechanisms of said first yarn package forming machine;

first means for transporting said yarn packages doffed by said doffing means into a yarn package transferring stage located between said first and second yarn package forming machines, said first transporting means having means for holding said doffed yarn packages;

second means for transporting said yarn packages from said yarn package transferring stage to said second yarn package forming machine when said yarn packages are transferred from said first transporting means onto said second transporting means, said second transporting means having means for holding said transferred yarn packages and being capable of functioning as creel means for supplying filament yarns to said second yarn package forming machine;

first means for conveying said first transporting means from a side of said first yarn package forming machine to said yarn package transferring stage and for returning said first transporting means from said yarn package transferring stage toward said first yarn package forming machine, and;

second means for conveying said second transporting means from said yarn package transferring stage to said second yarn package forming machine and for returning said second transporting means from said second yarn package forming machine toward said yarn package transferring stage.

6. The arrangement according to claim 5, wherein said holding means of said first transporting means comprises a plurality of yarn package holding pegs arranged at a pitch identical to that at which said winding spindles of said plurality of winding mechanisms of said first yarn package forming machine are arranged, and wherein said arrangement further comprises means for positioning and stopping said first transporting means at the side of said first yarn package forming machine while aligning said yarn package holding pegs with said winding spindles of said first yarn package forming machine.

7. The arrangement according to claim 6, wherein said first transporting means are provided with means for actuating a switch means stationarily arranged adjacent to said first yarn package forming machine, said switch means operating said positioning and stopping means upon being actuated.

8. The arrangement according to claim 6, further comprising means for transferring, at said yarn package transferring stage, said yarn packages from said first transporting means to said second transporting means.

9. The arrangement according to claim 8, wherein said transferring means comprises arm means for transferring said yarn packages held on said yarn package holding pegs of said first transporting means onto yarn package holding pegss provided for said second transporting means in a predetermined sequence.

10. The arrangement according to claim 5, wherein said first conveying means comprise a plurality of endless chain conveyers and drive motors for driving said endless chain conveyers, and wherein said first transporting means comprise pin means engageable with said endless chain conveyers of said first conveying means, and wheels attached to said first transporting means whereby when said endless chain conveyors of said first conveying means and said pin means of said first transporting means are engaged, said first transporting means are movable with said endless chain conveyers.

11. The arrangement according to claim 10, wherein said arrangement comprises a first storage located between said first yarn package forming machine and said yarn package transferring stage for storing said first transporting means loaded with said yarn packages, and a second storage located between said yarn package transferring stage and said first yarn package forming machine for storing said first transporting means returned from said yarn package transferring stage, said first and second storages being passed through by one of said endless chain conveyers, respectively.

12. The arrangement according to claim 5, wherein said second conveying means comprise a plurality of endless chain conveyers arranged between said yarn package transferring stage and a temporary storage located adjacent to said second yarn package forming machine for temporarily storing said second transporting means loaded with said yarn packages, drive motors for driving said plurality of endless chain conveyers, and a tractor capable of running past said temporary storage and said position above said second yarn package forming machine, and wherein said second transporting means comprise wheels and a pin engageable with said plurality of endless chain conveyers of said second conveying means thereby permitting said second transporting means to move with said plurality of endless chain conveyers.

13. The arrangement according to claim 12, wherein said arrangement comprises a storage located between said second yarn package forming machine and said yarn package transferring stage for storing said second transporting means returned from said second yarn package forming machine, said storage being passed through by one of said endless chain conveyers of said second conveying means.

14. The arrangement according to claim 5, wherein said second yarn package forming machine is arranged on a base floor lower than a different base floor on which said first yarn package forming machine is arranged, whereby said second transporting means are able to effect said supplying of said filament yarns to said second yarn package forming machine from above said second yarn package forming machine.

15. The arrangement according to claim 5, wherein said first yarn package forming machine consists of a machine selected from a spinning machine and spin-winding machine, and wherein said second yarn package forming machine consists of a machine selected from a drawing machine, draw-twisting machine, draw-false-twisting machine, and a false-twisting machine.

* * * * *

UNITED STATES PATENT AND TRADEMARK OFFICE

CERTIFICATE OF CORRECTION

PATENT NO. : 4,041,686

DATED : August 16, 1977

INVENTOR(S) : Mitugu Inaba et al

It is certified that error appears in the above-identified patent and that said Letters Patent are hereby corrected as shown below:

Col. 7, line 47, change "two dot dash" to --dashed--;

Col. 7, line 57, change "dashed" to --two dot dash--.

Signed and Sealed this

*Twenty-eighth* Day of *March 1978*

[SEAL]

*Attest:*

RUTH C. MASON
*Attesting Officer*

LUTRELLE F. PARKER
*Acting Commissioner of Patents and Trademarks*